US007443056B2

(12) United States Patent
Fisher et al.

(10) Patent No.: US 7,443,056 B2
(45) Date of Patent: Oct. 28, 2008

(54) JUNCTION DEVICE WITH LOGIC AND EXPANSION CAPABILITY

(76) Inventors: Philip H. Fisher, 6541 Nye Rd., Hudson, MI (US) 49247; Trent P. Fisher, 131 W. College St., Yellow Springs, OH (US) 45385; Larry J. Linder, 1546 Tamara Ter., Xenia, OH (US) 45385

( * ) Notice: Subject to any disclaimer, the term of this patent is extended or adjusted under 35 U.S.C. 154(b) by 194 days.

(21) Appl. No.: 11/478,166

(22) Filed: Jun. 29, 2006

(65) Prior Publication Data

US 2008/0048496 A1 Feb. 28, 2008

(51) Int. Cl.

| | |
|---|---|
| ***H01H 35/00*** | (2006.01) |
| ***H01R 13/62*** | (2006.01) |
| ***H01R 13/66*** | (2006.01) |

(52) U.S. Cl. ..... 307/116; 439/265; 439/620.01; 439/620.04; 439/620.11; 439/620.13

(58) Field of Classification Search ..... 307/116; 439/265, 620.01, 620.04, 620.11, 620.12, 439/620.13, 928

See application file for complete search history.

(56) References Cited

U.S. PATENT DOCUMENTS

| | | | |
|---|---|---|---|
| 3,711,827 | A | 1/1973 | Houseman |
| 4,072,936 | A | 2/1978 | Spirig |
| 5,460,210 | A | 10/1995 | Koeninger |
| 5,495,228 | A | 2/1996 | Futsuhara et al. |
| 6,271,747 | B1 | 8/2001 | Fendt et al. |
| 6,812,593 | B1 | 11/2004 | Fisher et al. |

*Primary Examiner*—Michael J Sherry
*Assistant Examiner*—Hal I Kaplan
(74) *Attorney, Agent, or Firm*—MacMillan, Sobanski & Todd, LLC

(57) ABSTRACT

A junction box receives a plurality of input signals. The input signals are combined in accordance with AND logic to provide an output signal when all input signals are present. Multiple junction boxes may be connected to one another to increase the number of input signals that are accepted.

20 Claims, 8 Drawing Sheets

JUNCTION DEVICE WITH LOGIC AND EXPANSION CAPABILITY

CROSS-REFERENCE TO RELATED APPLICATIONS

Not Applicable

BACKGROUND OF THE INVENTION

This invention relates in general to interfaces and junction boxes and in particular to multiple connected junction boxes that include logic functions.

Robotics is being increasingly being used in manufacturing situations to handle work pieces. Such robotic devices are known to pick up a work piece, transport the work piece to a work station, such as a numerically controlled machining operation, and install the work piece upon the work station. The robotic devices often include an arm that can swing, extend and elevate to move the work piece. The work piece itself is held in a gripper attached to the end of the arm. Such grippers are usually designed to accommodate the specific work piece and can include a plurality of fingers that close upon and thereby grasp the work piece.

The grippers are usually equipped with a plurality of position sensors that determine the position of the gripper fingers relative to the work piece. Such position sensors may be simple limit switches that are mechanically closed or opened upon contact with the work piece or may be more sophisticated proximity sensors that generate an output current or voltage as the fingers approach the work piece. Position sensors also can be mounted upon the robotic arm itself. The proximity type position sensors typically have an output stage that provides the sensor output signal to the robotic device. Upon receiving sensor output signals that all of the fingers are in place upon the work piece, the robotic device will proceed to the next step of its cycle, such as, for example, transporting the work piece to the next work station. Thus, the robotic device must receive a number of sensor output signals.

Position sensors also find wide spread use on machine tools and other mechanical devices where automatic control of movement is required. Thus, automatic processing machines and manufacturing equipment frequently include position sensors in their control systems to provide input signals to their logic circuits.

As described above, the position sensor output signals may be current sources generated by PNP output transistors or current sinks generated by NPN output transistors. Also, the input circuit of the associated robotic device may include either PNP or NPN devices. In the past, a specific junction box that is compatible with both the specific sensor output signal and the specific robotic device input signal requirements has been provided. This has increased the complexity of the design of robotic devices. Accordingly, it would be desirable to provide a common junction device or box that would be compatible with the different sensor output signals. It also would be desirable to provide a logic function in the junction device or box to provide a single output signal to the robotic device once all the sensors are indicating a closed status. By moving the logic to the junction box or device, the complexity of the robotic device wiring would be significantly reduced.

Additionally, it is known to connect several proximity sensors in series. Thus, an input signal is provided when all of the sensors are in a "closed position". With a prior art junction box, the common signal generated by the series connected proximity sensors is passed directly to the junction box output. However, it has been observed that when more than two proximity sensors are connected in series, the cumulative voltage drop across the sensors degrades the output signal excessively. Accordingly, it would be desirable to provide a junction box or device that is not affected by the series connection of sensors on an input to the box. Additionally, it would be desirable to have an expandable capability to accommodate a variable number of sensors that are connected in series.

BRIEF SUMMARY OF THE INVENTION

This invention relates to multiple connected junction boxes that include logic functions.

The present invention is directed toward an improved junction box or device that receives output signals from a plurality of sensors, or other devices, and is operable to generate a single output upon receipt of output signals from all of the sensors. The junction box or device includes the capability to be connected to a second junction box to expand the number of input signals that may be accepted. Additional junction boxes may be connected to the second junction box to further expand the available number of input signals that may be accepted.

Accordingly, the present invention contemplates a junction box having a plurality of input devices adapted to be connected to at least two signal sources. An isolation device is electrically connected to the input devices and an electrical expansion connector having at least two pins with one of the pins connected to the isolation device. The junction box also includes at least one output device adapted to be connected to an electrical device with the output device connected to the other pin of the expansion connector and isolated by the isolation device from the input devices. The output device is capable of being switched between a first state and a second state. The junction box further includes a device removably inserted into the expansion connector that provides an electrical path between the two pins of the expansion connector with the isolation device operable through the electrical path to cause the output device to change from the first state to the second state when there is a signal present at each of the input devices.

The invention further contemplates that the device inserted into said expansion connector is either a jumper or a connector to a second connection device that includes a second isolation device electrically connected to a second plurality of input devices. The second isolation device being operable to allow a current flow therethrough only when there is a signal present on each of the second plurality of input devices with the first and second connection devices co-operating to cause the output device to change from the first to the second state only when there is a signal present at each of the first plurality of input devices and the second plurality of input devices.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
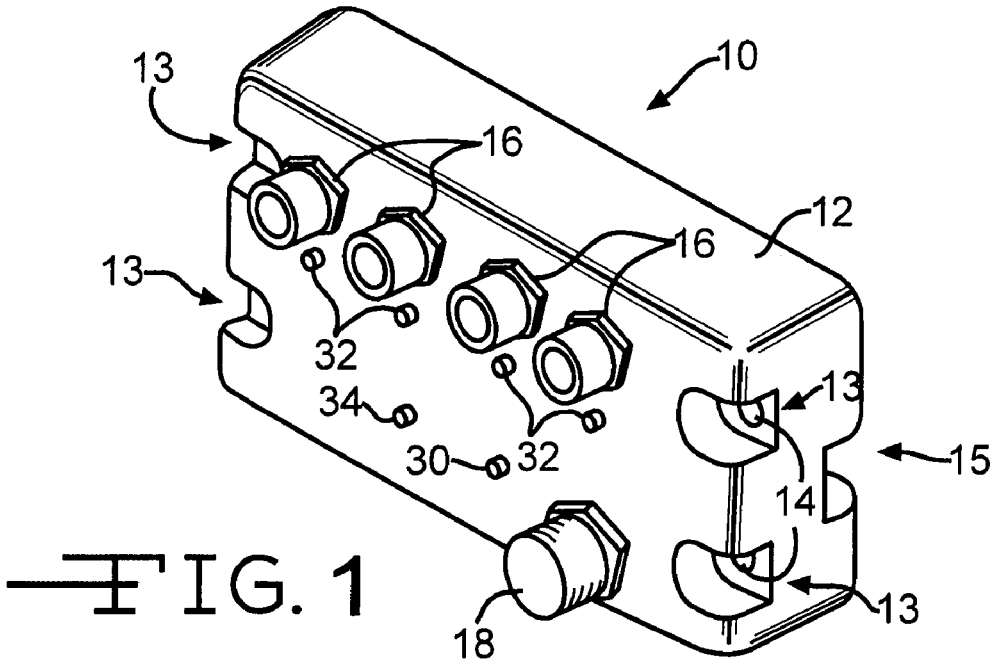
FIG. 1 is a perspective front view of an interface junction device that is in accordance with the present invention.
Figure 2:
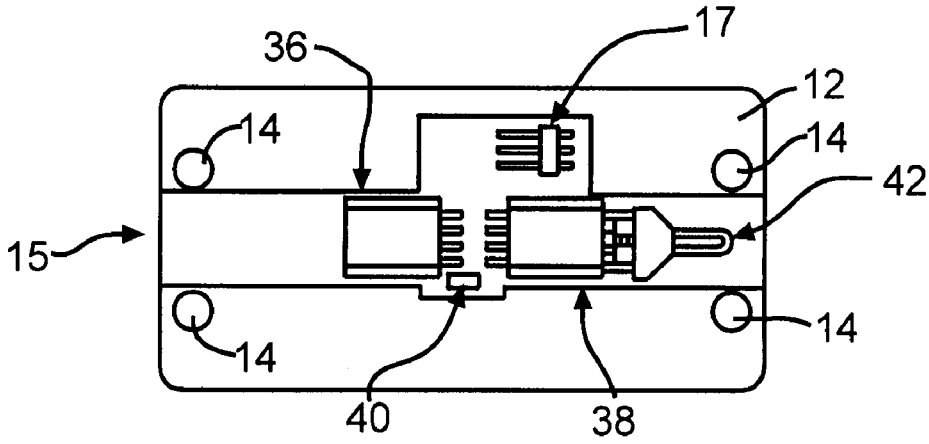
FIG. 2 a rear view of the interface junction device shown in FIG. 1.

Referring now to the drawings, there is illustrated in FIG. 1 a perspective view of an interface junction device 10 that is in accordance with the present invention. The junction device 10 includes a housing 12 that, in the preferred embodiment is a solid injection molded enclosure. It will be appreciated that the invention also may be practiced with other commercially available housings, such as, for example, a drip proof NEMA 4 enclosure. A pair of mounting recesses 13 is formed at each end of the housing 12 and a bore 14 extends through the housing 12 from the base of each of the recesses 13 to permit surface mounting of the junction box 10. As best seen in FIG. 2, a multiple connector recess 15 extends across a rear surface of the housing 12 and between the mounting bores 14.

A plurality of electrical input connectors 16 are disposed upon the front surface of the housing 10. In the preferred embodiment, four 3-pin 8 mm PICO connectors are used for the input connectors 16; however, the invention also may be practiced with other connectors than the ones shown in FIG. 1. The input connectors 16 are arrayed across the upper portion of the top surface of the housing 10 in FIG. 1. Thus, the junction box 10 shown in FIG. 1 is designed to receive up to four discrete input signals. The invention also can be practiced for more or less input signals. Specifically, the inventors have designed boxes for two, four, six or eight input signals; however, it is not intended that the maximum number of input signals be limited to eight. Likewise, as will be explained below, the invention also can be practiced for an odd number of input signals. As shown in FIG. 2, a two position shorting plug 17 is disposed in the rear connector recess 15. As will be explained below, the position of a jumper for the two position shorting plug 17 is selected to match the input connectors 16 to input devices with the jumper being placed in a first position for PNP input devices and in a second position for NPN input devices. The center pin for the shorting plug 17 is common for both possibilities. Thus, for the embodiment shown in the figures, all input connectors 16 are intended to be connected to the same type of input device. It will be appreciated that, by providing additional shorting plugs for each of the input connectors 16 (not shown), the invention also may be practiced with individual selection of each of the input connectors to match the input device connected thereto. Thus, different devices may be connected to the junction box input connectors.

Figure 3:
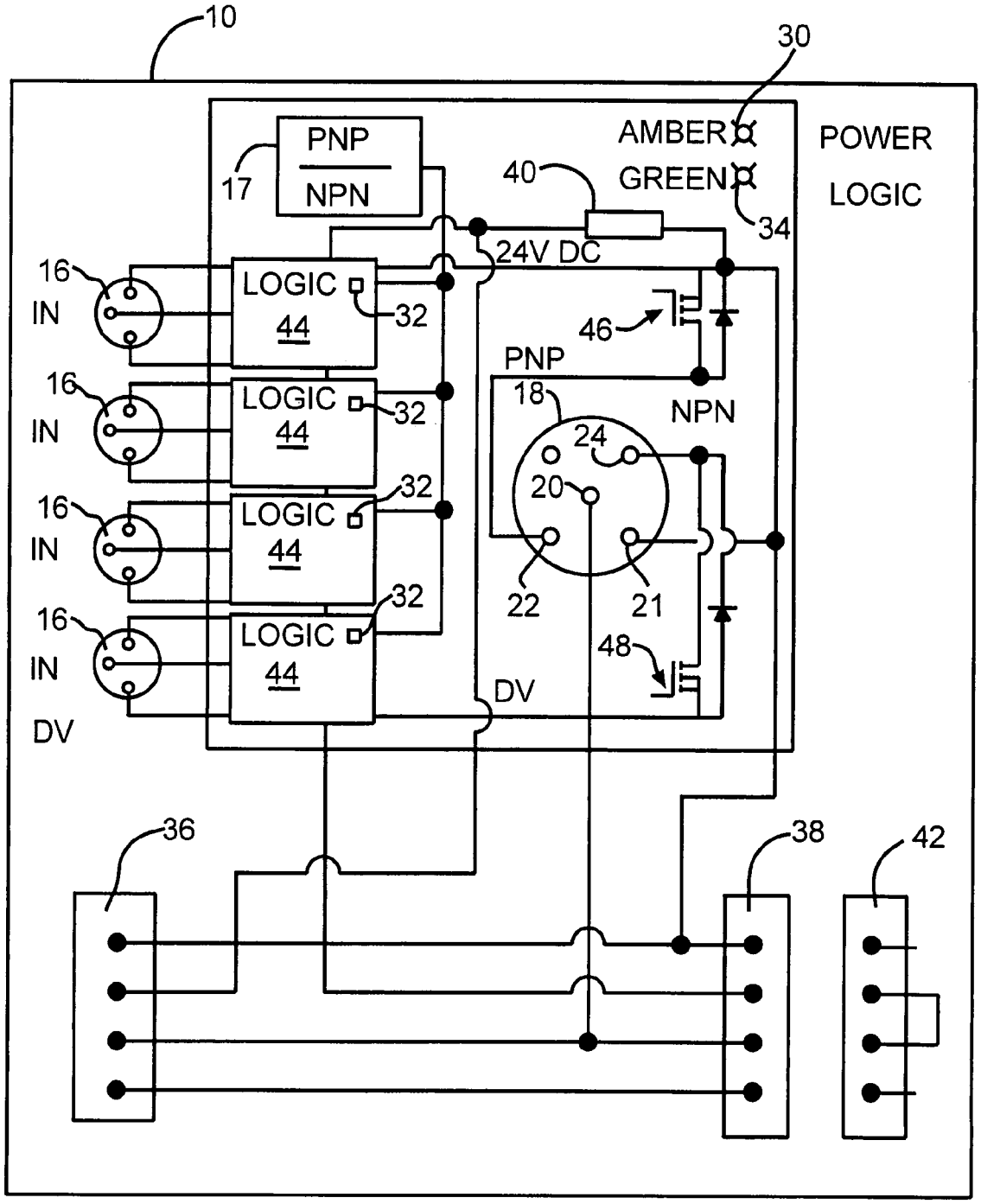
FIG. 3 illustrates the input/output logic of the interface junction device shown in FIG. 1.
Figure 4:
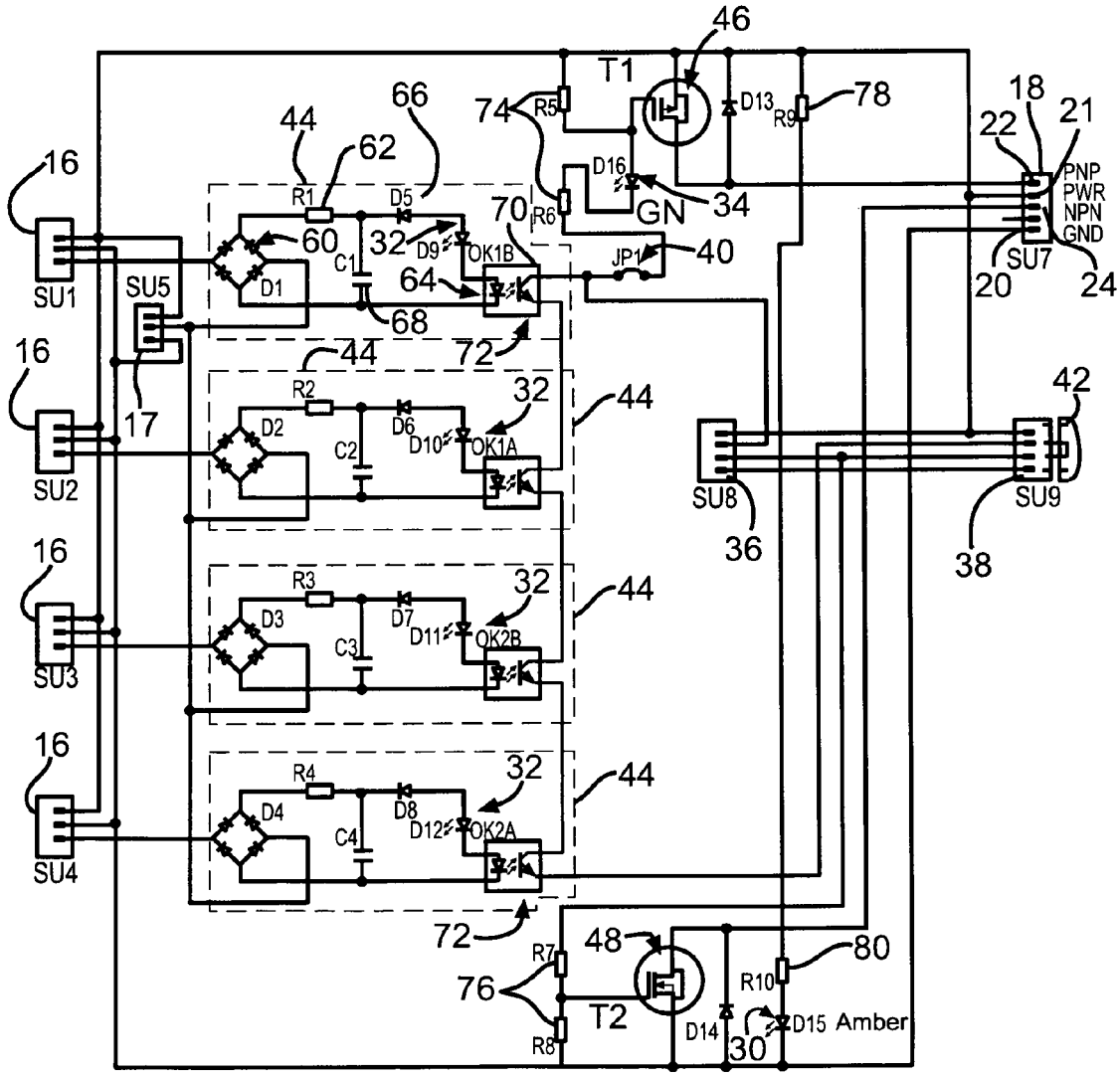
FIG. 4 is a circuit diagram for the interface junction device that is shown in FIG. 1.

In the preferred embodiment, a single 5-pin 12 mm output connector 18 is provided along the lower portion of the front surface of the housing 10 in FIG. 1; however, it will be appreciated that the invention also may be practiced with other output connectors. As shown in FIGS. 3 and 4, four of the five pins in the output connector 18 are utilized. A common, or ground pin, 20 is provided in the center of the output connector while power is supplied to the pin labeled 21. As will be explained below, the power and ground terminals 21 and 20 are used to supply power to the components within the junction box 10. In the preferred embodiment, the power supply is +24 volts D.C.; however, the invention also can be practiced with other values of supply voltage, such as, for example 12 or 48 volts. Additionally, the invention also can be practiced with −12, −24 or −48 volt D.C. supplies connected to the common terminal 20 and a ground connection attached to the other terminal 21. The output connector 18 also includes a first output pin that is labeled 22 and is compatible with a PNP solid state device. Similarly, a second output pin that is labeled 24 is compatible with a NPN solid state device.

A power supply Light Emitting Diode (LED) 30 is located upon the front surface of the housing 12 and is illuminated to indicate that power is being supplied to the junction box 10. In the preferred embodiment, the power supply LED 30 has an amber color. A plurality of LED's that are labeled 32 are provided with each of the LED's 32 adjacent to a corresponding input connector 16 and associated with an input circuit that is connected to the particular input connector. The LED 32 is illuminated when an input signal is received at the associated input connector 16. In the preferred embodiment, the input circuit LED's 32 have a yellow color. Finally, a logic indicator LED 34 is provided upon the front surface of the housing 12. As will be explained below, the junction box 10 generates an output signal only when there is an input signal present at all of the input connectors 16. Accordingly, the junction box 10 contains an "AND" logic circuit. The logic indicator LED 34 is illuminated when all inputs are present and, in the preferred embodiment, has a green color. Thus, the junction box 10 provides a visual indication of the status of the power supply, each input source and a logic TRUE status.

Alternately, the junction box 10 can be configured with multiple terminals (not shown) in place of multi-pin plugs. The multi-pin plugs 16 and 18 can be electrically connected to cables that end in corresponding female connectors.

A rear view of the junction box 10 is shown in FIG. 2. As shown in FIG. 2, 4-pin input and output multiple junction box connectors, 36 and 38, respectively, are mounted within the multiple connector recess 15. As will be explained below, the multiple box connectors 36 and 38 allow a series connection of multiple junction boxes 10. Additionally, a zero ohm resistor 40 is also mounted in the recess 15. As will be explained below, the resistor 40 functions as an expansion jumper that is removed to convert the junction box 10 into a multiple unit configuration. Finally, a termination plug 42 is shown inserted into the output connector 38. As will also be explained below, the termination plug 42 is replaced by an expansion cable (not shown in FIG. 2) when multiple junction boxes are connected. Thus, FIG. 2 illustrates the configuration of the junction box 10 for single box operation.

A block diagram that illustrates the logic for the junction box 10 shown in FIG. 1 is provided in FIG. 3. Components shown in FIG. 3 that are the same as shown in FIG. 1 have the same numerical designators. Two different types of input circuits may be connected to the input connectors 16. The center pin of each connector 16 is an input connection while the while the upper pin in FIG. 3 is a positive power connection and the lower pin in FIG. 3 is a ground connection. Thus, PNP devices are connected across the upper pin and the input pin of each connector 16 and NPN devices are connected across the input pin and ground of each connector. Each of the input connectors 16 is connected to a corresponding logic circuit 44, which is described below. A two position shorting plug 17 is electrically connected to each of the logic circuits 44 and is set in a first position for PNP input signals and a second position for NPN input signals. Thus, the junction box 10 is compatible with all PNP input devices or all NPN input devices. In the preferred embodiment, the input devices are proximity type position sensors; however, the invention also may be practiced with other devices supplying the input signals.

A P channel power Field Effect Transistor (FET) 46 is connected between the power supply line and the PNP output pin 22 while an N channel power FET 48 is connected between the ground line and the NPN output pin 24. As shown in FIG. 4, and explained below, the gates of each of the FET's are connected to the logic circuits 44. When there is no gate signal present, the FET's 46 and 48 are in their non-conducting state. While the upper output transistor 46 is shown in FIG. 3 as a P channel power Field Effect Transistor (FET); the upper output transistor 46 also can be a PNP bipolar device (not shown). Similarly, while the lower output transistor 48 is shown in FIG. 3 as an N channel power Field Effect Transistor (FET); the lower output transistor 48 also can be a NPN bipolar device (not shown).

Also shown in FIG. 3 are the 4-pin input and output multiple junction box connectors, 36 and 38, and the termination plug 42. The top and bottom pins of the input and output multiple junction box connectors 36 and 38 are connected to one another. The second pin from the top of the input connector 36 is connected to the top logic circuit 44 shown in FIG. 3, while the third pin from the top is connected to ground. The second pin from the top of the output connector 38 is connected to the bottom logic circuit 44 while the third pin from the top is connected to the junction box ground, and, thus, is also connected to the third pin from the top of the input connector 36. As shown in FIG. 3, the termination plug 42 has the second and third pins from the top electrically connected together while the top and bottom pins remain open. When the termination plug 42 is inserted into the output connector 38, the junction box 10 is configured for single box operation. As also shown in FIG. 3, the expansion jumper 40 is inserted between the power source and the top logic circuit 44.

When a signal is present at a pair of input connector pins, the corresponding yellow input status indicator LED 32 is illuminated. Upon detection of a signal at a pair of input connector pins a signal is sent to an "AND" logic circuit, that will be discussed below. Upon receiving signals from all inputs, the logic circuit 44 illuminates the green status indicator LED 34 and the FET's 46 and 48 are switched to their conducting states. Hence, when the upper output FET 46 is switched to its conducting state, it supplies current from the power terminal 21 to the PNP output terminal 22. Similarly, when the lower output FET 48 is switched to its conducting state, it draws current from the NPN output terminal 24 and directs the current to the common, or ground terminal 20. Thus, the junction box 10 is compatible for an output connection to either a PNP device, an NPN device or simultaneously to both a PNP device and an NPN device.

Figure 4A:
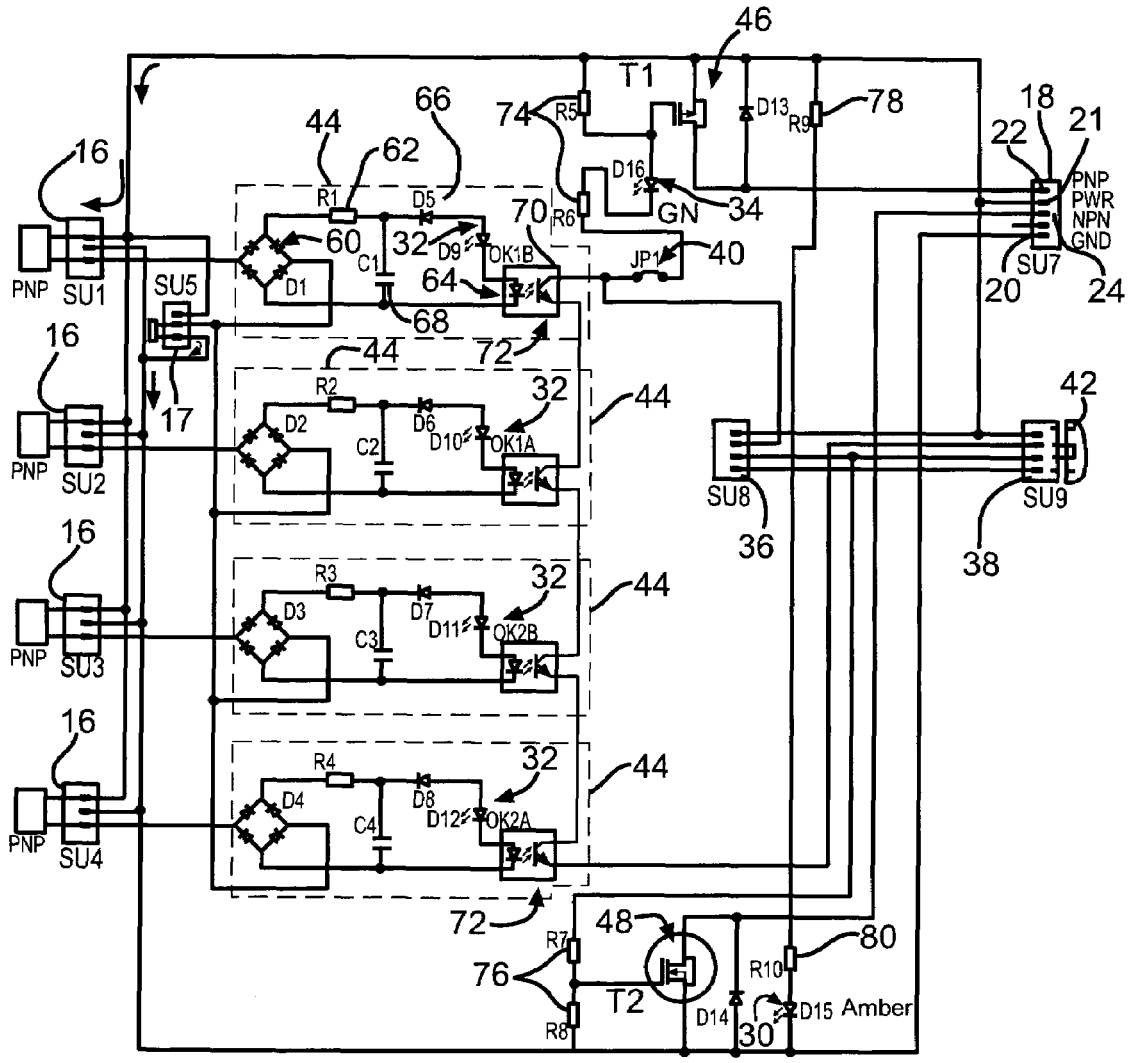
FIG. 4A is a circuit diagram for the interface junction device shown in FIG. 1 configured for PNP input devices.
Figure 4B:
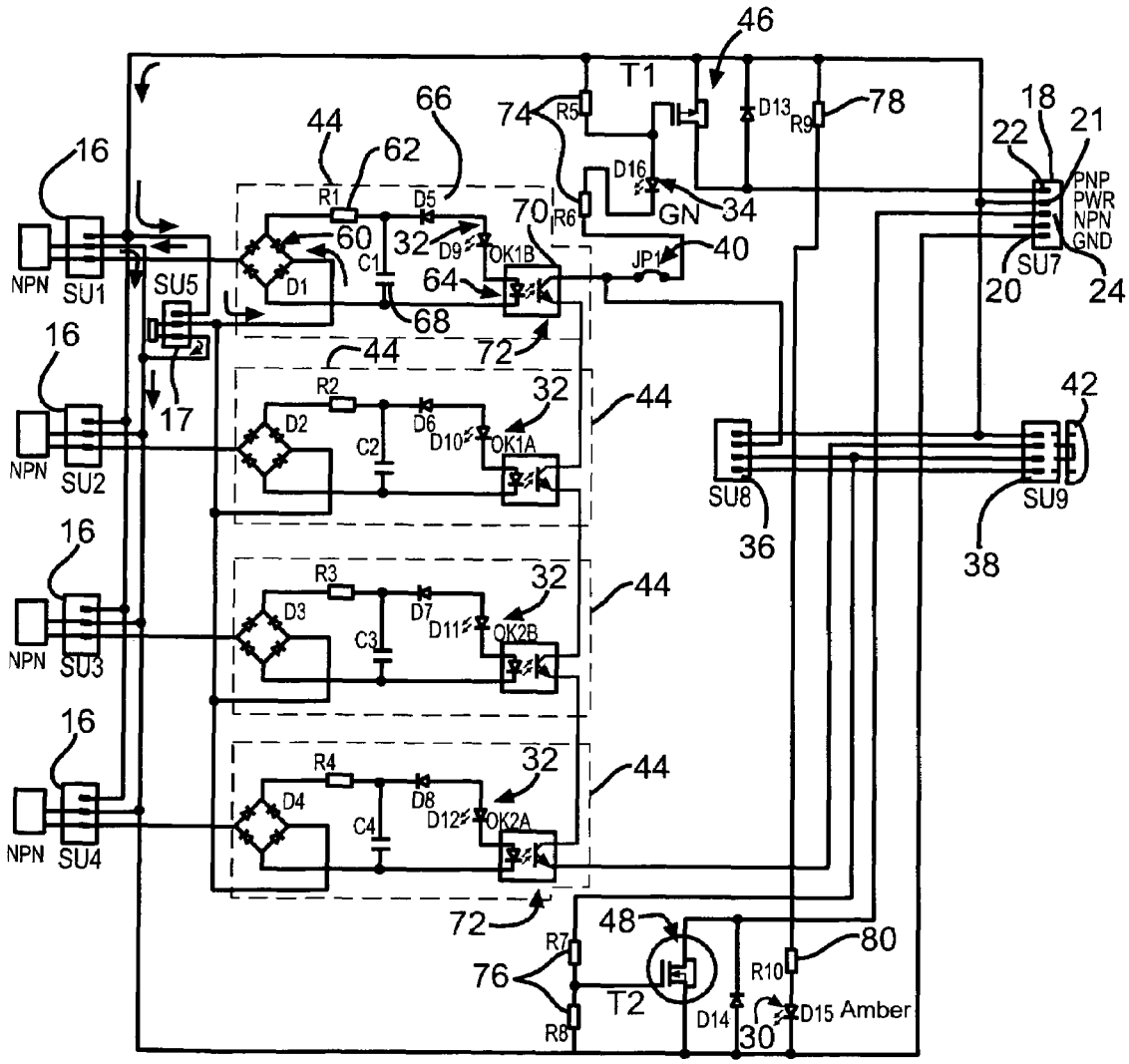
FIG. 4B is a circuit diagram for the interface junction device shown in FIG. 1 configured for PNP input devices.

A circuit diagram for the four input connector version of the invention is shown in FIG. 4. As before, components in FIG. 4 that are the same as components shown in FIGS. 1 through 3 have the same numerical designators. Each of the input connectors 16 is connected to an identical logic circuit 44. Accordingly, only one of the four logic circuits 44 will be described in detail. The pins of the input connectors 16 are connected to a full wave bridge rectifier 60. As shown in FIG. 4, the bottom pin on each of the input connectors is the input pin that is connected to the bridge rectifier 60. The upper pin is connected to the positive power supply line while the center pin is connected to ground. The bridge rectifier 60 enables acceptance of either a positive or a negative input signal. The reference for each input is selected using the two position shorting plug 17. As illustrated in FIG. 4A, the lower, or ground pin of the shorting plug 17 is connected with a jumper to the center pin for inputs from PNP devices. The directional flow of current through the PNP device and the bridge rectifier 60 is illustrated for top input connector 16 by the small arrows in FIG. 4A. As illustrated in FIG. 4B, the upper pin of the shorting plug 17 is connected with a jumper to the center pin for inputs from NPN devices. The resulting reversed directional flow of current through the NPN device and the bridge rectifier 60 is again illustrated for top input connector 16 by the small arrows in FIG. 4B. While a shorting plug 17 has been shown in FIGS. 4, 4A and 4B, it will be appreciated that the invention also can be practiced with a miniature switch, such as, for example, a dip switch, a programmable EPROM cell, an active semiconductor or a toggle switch.

The output of the bridge rectifier 60 is connected across an optical coupler diode 64. A current limiting resistor 62 is connected between the bridge rectifier 60 and the optical coupler diode 64. Additionally, a Zener diode 66 that limits the voltage level and the corresponding input status LED 32 are connected between the current limiting resistor 62 and the bridge rectifier 60. A capacitor 68 is connected across the Zener 66, status LED 32 and optical coupler diode 64 to filter out high frequency signals and electromagnetic radiation effects.

The optical coupler diode 64 is included in a conventional dual optoisolator transistor 70 that includes an output transistor 72. When a signal is present across the pins of the input connector 16, the bridge rectifier 60 causes a current to flow through the optical coupler diode 64. The diode 64 is responsive to the current to illuminate the output transistor 72. Upon illumination, the output transistor 72 saturates, or changes from a non-conducting to a conducting state. The output transistor 72 remains saturated as long as an input signal is present across the input terminals 16. Upon removal of the input signal, the diode 64 is extinguished and the output transistor 72 reverts to its non-conducting state. The optoisolator dual transistors 70 provide isolation between the input signals and the output signal.

As shown in FIG. 4, each of the logic circuits 44 includes a corresponding opto-isolator dual transistor 70 with an output transistor 72. All of the output transistors 72 are connected in series to form the AND logic circuit mentioned above. The series connection of the output transistors 72 are separated from both the power supply and ground by pairs of gate bias resistors 74 and 76. Additionally, the green logic status LED 34 and the zero ohm expansion jumper 40 are connected in series with the upper pair of bias resistors 74 and the output transistor 72 of the top logic circuit 44. Furthermore, the center pins of the output connector 38 are connected between the output transistor emitter of the bottom logic circuit 44 and the lower pair of bias resistors 76. The series connection of the output transistors 72 provides the AND logic function since a current can only flow through the transistors 72 when all of the transistors 72 are in their conducting state and the termination plug 42 is inserted into the output connector 38. This condition can only exist when all of the optioisolator dual transistors 70 are activated by inputs being present on all of the input connectors 16.

The gate of the upper output transistor 46, which is shown as a P channel power FET in FIG. 4, is connected via the upper pair of bias resistors 74 to the collector of the top output transistor 72, while the gate of the lower output transistor 48, which is shown as an N channel power FET, is connected via the lower pair of bias resistors 76 to the emitter of the bottom output transistor 72. The drain of the P channel power FET 46 is connected to the PNP output terminal 22. Similarly, the drain of the N channel FET 48 is connected to the NPN output terminal 24.

Finally, as also shown in FIG. 4, one lead for the amber power status LED 30 is connected through a pair of current limiting resistors 78 and 80 to the power supply terminal 21 while the other lead is connected to the ground terminal 20. Thus, the power status LED 30 is illuminated whenever there is power present at the supply terminal 21.

The operation of the circuit will now be explained. The outputs or the proximity sensor circuits are connected to the input connectors 16. Upon a sensor signal being generated across a pair of input connector pins, the corresponding yellow input status LED 32 is illuminated and the corresponding optoisolator dual transistor 70 is switched to its conducting state. When sensor signals are present at all of the inputs, all of the optoisolator dual transistors 70 are conducting and the resulting current flowing through the gate bias resistors causes a voltage to appear across the gates of the FET's 46 and 48 switching both of the FET's from non-conducting states to conducting states. When configured for single box operation, the current flowing through the optoisolator dual transistors also flows through the expansion jumper 40 and the center connected pins of the termination plug 42. Additionally, the green logic status LED 34 is illuminated. With the FET's 46 and 48 in their conducting states, current can flow through the corresponding output terminal pins 22 and 24, respectively.

Upon any one of the input signals being interrupted, the corresponding optoisolator dual transistor 72 will revert to its non-conducting state which will block the flow of current through the gate bias resistors 73. As a result the output FET's 46 and 48 will revert to their non-conducting state and thereby block any current flow through their respective output terminals 22 and 24.

As was indicated above, the circuit shown in FIG. 3 is intended to be exemplary. The invention may be practiced with two or more input circuits. In the preferred embodiment, the number of input circuits is intended to be an even number. However, it is possible to practice the circuit with an odd number of input circuits (not shown). Additionally, it also is possible to use an embodiment of the junction box having an even number of input circuits with an odd number of input signals. All that is needed is to jumper the input terminals of the unneeded input circuit to the power source and ground to simulate an input signal and to cause the associated optoisolator dual transistor output transistor 72 to switch to its conducting state.

Figure 5:
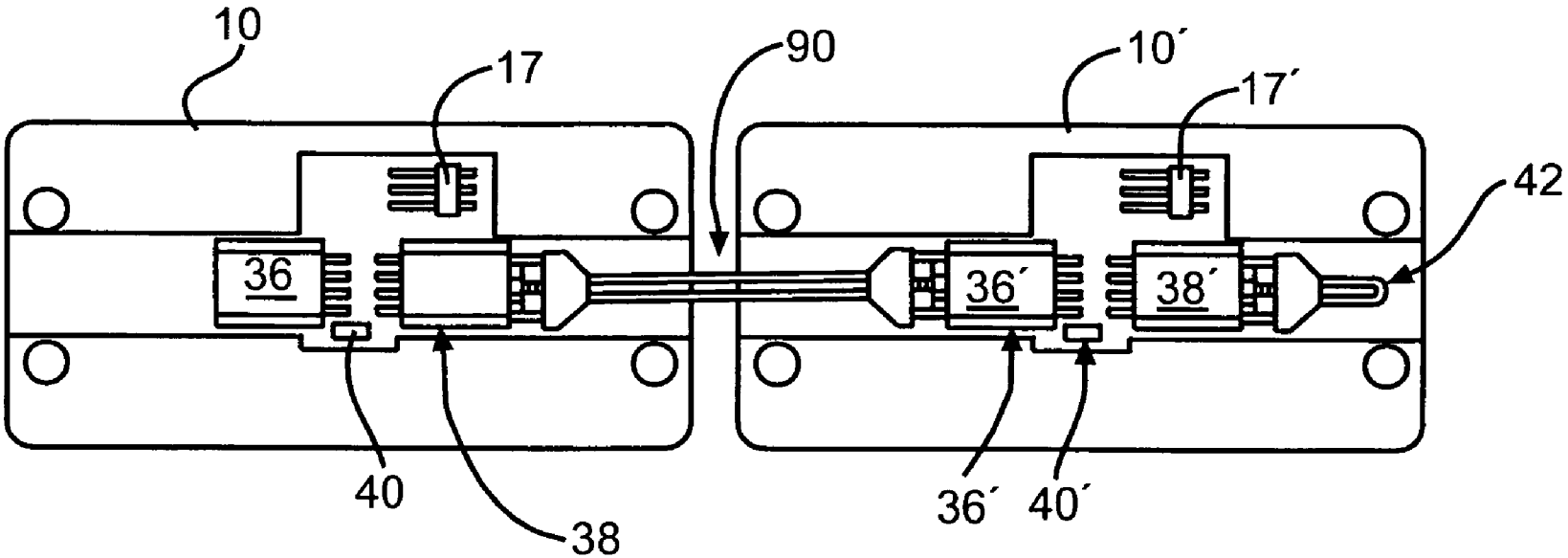
FIG. 5 is a rear view of the connection of two of the interface junction devices as shown in FIG. 1.

As described above, the invention also contemplates connecting two or more junction boxes in tandem to accommodate additional input signals. Such a connection for two junction boxes is illustrated in FIG. 5 where rear views of first and second junction boxes labeled 10 and 10', respectively, are shown. As before, components that are similar to components shown in the other drawings have the same numerical designators. In FIG. 5, the junction box 10 on the left is the master junction box while the junction box 10' on the right is the expansion junction box. Accordingly, the termination plug 42 is moved from the output connector 38 of the master junction box 10 to the output connector 38' of the expansion junction box 10'. A four wire expansion cable 90 is then connected between the output connector 38 of the master junction box 10 and the input connector 36' of the expansion junction box 10'. Additionally, the expansion jumper 40' of the expansion junction box 10' is opened to convert the junction box to an expansion junction box configuration. If a zero ohm resistor is used for the expansion jumper 40', the resistor may be easily removed by cutting with a small pair of diagonal cutters. Alternately, if a dip switch or a similar device is utilized for the jumper, a simple movement of the toggle will open the jumper 40'. A review of FIG. 4 will show that opening of the jumper 40' prevents current from flowing from the power source to the collector of the output transistor 72 of the top logic circuit 44. However, upon connecting the expansion box 10' to the master box 10, power for the logic circuits 44 is available from the master junction box via the second pin from the top of the input connector 36' of the expansion box 10'.

Figure 6:
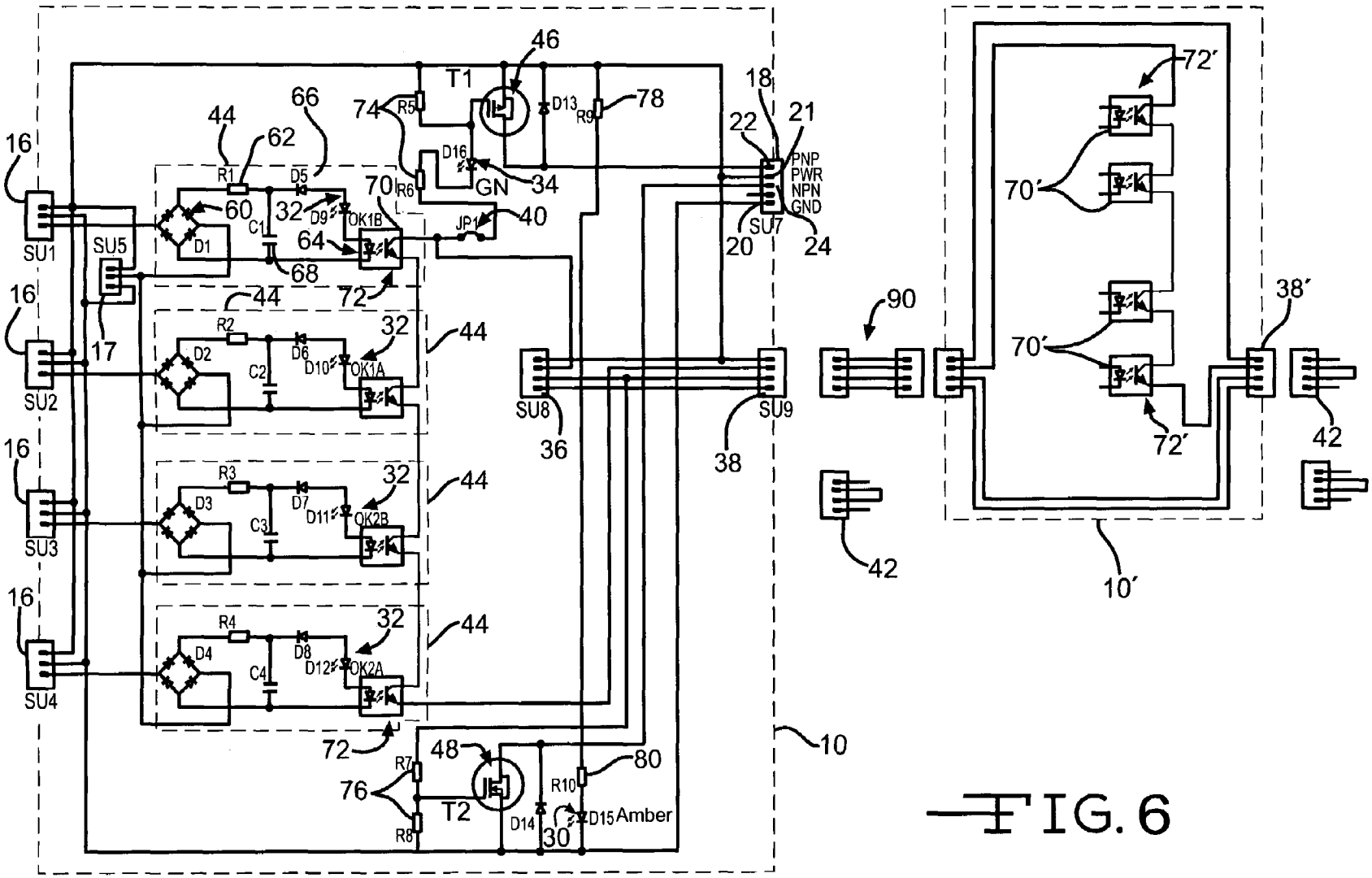
FIG. 6 is a partial circuit diagram illustrating the connection of the two interface junction devices shown in FIG. 5.

The circuits of the connected junction boxes 10 and 10' are shown in FIG. 6, where components that are similar to components shown in the other figures have the same numerical designators. In the interest of clarity, and because the circuits of the junction boxes 10 and 10' are identical, except for the removal of the expansion jumper 40', details of the expansion junction box circuit are omitted from FIG. 6. Thus, only the optoisolator dual transistors 70' are shown for the expansion junction box 10'.

As shown in FIG. 6, when a signal is present on all of the input connectors 16 of the master box 10, the output current from the emitter of the bottom optoisolator output transistor 72 in the master junction box 10 flows through second pin from the top of the output connector 38 to the expansion junction box input connector 36'. The current then flows to the collector of the top optoislator output transistor 72'. When there are signals present on all of the expansion box input connectors (not shown), all of the optoisolator output transistors 72' will be conducting and the current will flow through the transistors to the second pin from the top of the expansion box output connector 38'. The termination plug 42 will then return the current to the third pin from the top of the expansion box output connector 38'. From there, the current will flow directly back through the third wire from the top of the expansion cable 90 and into the corresponding pin of the master box output connector 38. The current then continues to the lower pair of bias resistors 76. The same current also is flowing through the upper pair of bias resistors 74. Accordingly, the voltages developed across the bias resistors 74 and 76 causes both power FET's 46 and 48 to switch from non-conducting states to conducting states. As a result, the green LED 34 is illuminated and the PNP and NPN pins 22 and 24 of the output connector 18 on the master box 10 are activated. Because the expansion jumper 40' is open, the green LED and PNP bias resistors in the expansion box 10' are not activated. Thus, only the output of the master box 10 is available, and only when all eight inputs of the combined master and expansion boxes 10 and 10' have signals present. Because each junction box is provided with a PNP/NPN shorting plug 17, selectively positioning the shorting plug allows the master and expansion boxes to have the same or different polarities. Thus, the master and expansion junction boxes inputs may be connected to all PNP devices, all NPN devices, or any combination of both PNP and NPN devices.

While two junction boxes 10 and 10' are shown in FIG. 6, it will be appreciated that additional expansion boxes (not shown) up to 10$^{n}$ may be added to further increase the number of input signals that may be accepted. The expansion jumper of each additional junction box is removed and an additional expansion cable used to connect the input connector of the new expansion box to the output connector of the last expansion junction box. Additionally, the termination plug 42 is inserted into the output connector 38$^{n}$ of the last expansion junction box 10$^{n}$.

An expansion box may be returned to a single box configuration by closing the expansion jumper 40 and replacing the termination plug 42 in the output connector 38. If a zero ohm resistor is utilized for the expansion jumper 40, a connecting wire is simply soldered across the ends of the severed resistor. If a dip switch is utilized for the expansion jumper 40, the toggle is returned to the original position. Closing the expansion jumper 40 and connecting an expansion cable 90 to the output connector 38 will convert an expansion box into a master box.

Figure 7:
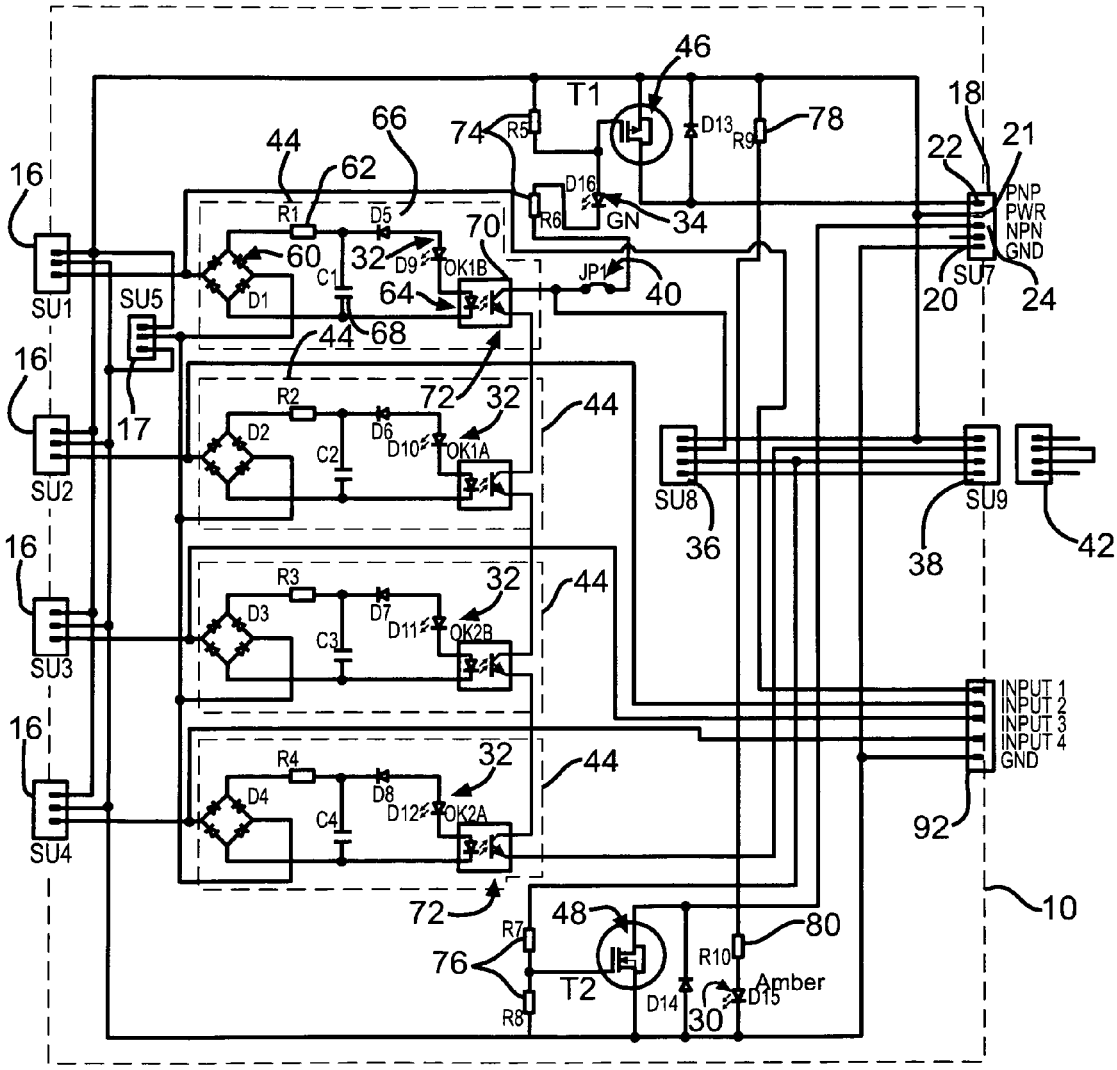
FIG. 7 is a circuit diagram for an alternate embodiment of the interface junction device shown in FIG. 1.

The inventors also contemplate an alternate embodiment that is illustrated in FIG. 7. As before, components in FIG. 7 that are the same as components in the preceding figures have the same numerical designators. As shown in FIG. 7, the input circuits are the same as shown in FIG. 4, except that a lead now runs from one of the pins in each of the input connectors 16 to a corresponding pin in a second 5-pin output connector 92. A fifth pin in the second output connector 92 is connected to ground. Thus, a signal appearing at an input connector 16 is transferred to a corresponding pin on the second output connector 92. Because an output signal is available whenever any input signal is present, the circuit in FIG. 7 also functions as a pass through circuit. The inventors have found that one printed circuit board can be utilized to produce either of the circuits shown in FIGS. 4 and 7 and thus have achieved substantial cost reductions.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope. Thus, while the invention has illustrated and described as a junction box and interface between a plurality of sensors and a robotic device, it will be appreciated that the invention also can be used for other purposes, such as, for example, machine to controller wiring for PLC controls. Thus, the invention can be included in any machine tool or other device requiring inputs connected to outputs. The invention not only provides the capability to combine input signals by also provides a visual indication of the status of the individual sensors and the internal logic.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A connection device comprising:

a plurality of input devices adapted to be connected to at least two signal sources;

an isolation device electrically connected to said input devices;

an electrical expansion connector having at least two pins with one of said pins connected to said isolation device;

at least one output device adapted to be connected to an electrical device; said output device connected to said other pin of said expansion connector, said output device isolated by said isolation device from said input devices and capable of being switched from a first state to a second state; and a device removably inserted into said expansion connector that provides an electrical path between said two pins of said expansion connector with said isolation device operable through said electrical path to cause said output device to change from said first state to said second state when there is a signal present at each of said input devices.

2. The connection device according to claim 1 wherein said isolation device connected to said input device includes an AND logic circuit.

3. The connection device according to claim 2 wherein each of said input devices includes a full wave rectifier connected between the corresponding signal source and said AND logic circuit.

4. The connection device according to claim 3 wherein said AND logic circuit includes a plurality of optoisolator dual transistors connected in series, said optoisolator dual transistors having inputs connected to the outputs of said rectifier bridge circuits such that a current flows through said optoisolator dual transistors only when an input signal is present for all of said rectifier bridge circuits, said device operative to cause said output device to change from a first state to a second state when there is a signal present at each of said input terminals.

5. The connection device according to claim 4 wherein said device inserted into said expansion connector is a jumper.

6. The connection device according to claim 4 wherein the connection device is a first connection device and said plurality of input devices is a first plurality of input devices and further wherein said device inserted into said expansion connector is a connector to a second connection device that includes a second isolation device electrically connected to a second plurality of input devices, said second isolation device operable to allow a current flow therethrough only when there is a signal present on each of said second plurality of input devices, said first and second connection devices co-operating to cause said output device to change from said first to said second state only when there is a signal present at each of said first plurality of input devices and said second plurality of input devices.

7. The connection device according to claim 6 wherein said second connection device includes a power source that is connected through an expansion jumper to said second isolation device, said expansion jumper being opened when said second connection device is connected to said first connection device to isolate said second isolation device from said power source.

8. The connection device according to claim 7 wherein said second connection device includes a second electrical expansion connector and further wherein said second expansion connector receives a connector for a third connection device that includes a third isolation device electrically connected to a third plurality of input devices and operable to allow a current flow therethrough only when there is a signal present on each of said third plurality of input devices, said third connection device co-operating with said first and second connection devices to cause said output device to change from said first to said second state only when there is a signal present at each of said first plurality of input devices and said second plurality of input devices device co-operating with said first and second connection devices to cause said output device to change from said first to said second state only when there is a signal present at each of said first plurality of input devices and said second plurality of input devices and said third plurality of input devices.

9. The connection device according to claim 7 wherein said output device includes a PNP electronic switching device that is changed from a non-conducting state to a conducting state when said current is flowing through said optoisolator dual transistors.

10. The connection device according to claim 9 wherein said PNP electronic switching device is a bipolar transistor.

11. The connection device according to claim 7 wherein said output device includes a NPN electronic switching device that is changed from a non-conducting state to a conducting state when said current is flowing through said optoisolator dual transistors.

12. The connection device according to claim 11 wherein said NPN electronic switching device is a bipolar transistor.

13. The connection device according to claim 7 further including an input status light emitting diode connected to each of said full wave rectifiers, the input status diode being illuminated when an input signal is present.

14. The connection device according to claim 13 further including a logic status light emitting diode connected between two of said optoisolator dual transistors, said logic status light emitting diode being illuminated when said current is flowing through said optoisolator dual transistors.

15. The connection device according to claim 14 further including a PNP/NPN selector switch that is operable to match said input devices to said input signal sources.

16. The connection device according to claim 7 wherein said output device includes an electronic switching device that is changed from a non-conducting state to a conducting state when said current is flowing through said optoisolator dual transistors.

17. The connection device according to claim 16 wherein said electronic switching device is a P-channel field effect transistor.

18. The connection device according to claim 16 wherein said electronic switching device is a N-channel field effect transistor.

19. The connection device according to claim 7 wherein said expansion jumper is a switch that is operable to be opened to remove said jumper and subsequently closed to replace said jumper.

20. The connection device according to claim 7 wherein said expansion jumper includes a resistor that is removed to open said jumper.

* * * * *